US007868563B2

(12) United States Patent
Ito et al.

(10) Patent No.: US 7,868,563 B2
(45) Date of Patent: Jan. 11, 2011

(54) LIGHT EMITTING DEVICE DRIVE CIRCUIT AND VEHICLE LAMP USING THE SAME

(75) Inventors: Masayasu Ito, Shizuoka (JP); Yoshihiro Uchiyama, Shizuoka (JP); Takanori Namba, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 440 days.

(21) Appl. No.: 11/962,726

(22) Filed: Dec. 21, 2007

(65) Prior Publication Data

US 2008/0157678 A1 Jul. 3, 2008

(30) Foreign Application Priority Data

Dec. 27, 2006 (JP) ..... P.2006-352766

(51) Int. Cl.
*G05F 1/00* (2006.01)

(52) U.S. Cl. ..... 315/309; 315/299; 315/307; 315/32

(58) Field of Classification Search ..... 315/291, 315/297, 299, 300, 301, 307, 309, 32, 55, 315/77

See application file for complete search history.

(56) References Cited

U.S. PATENT DOCUMENTS 7,154,921 B2 12/2006 Kitamura et al.
2004/0179366 A1 9/2004 Takeda et al.
2006/0274544 A1 12/2006 Inoue et al.

FOREIGN PATENT DOCUMENTS

JP 2003-272210 A 9/2003
JP 2004-276738 10/2004

(Continued)

OTHER PUBLICATIONS

Korean Office Action for Korean Application No. 10-2007-0137565, mailed on Mar. 25, 2010 (11 pages).

(Continued)

*Primary Examiner*—Douglas W Owens
*Assistant Examiner*—Jianzi Chen
(74) *Attorney, Agent, or Firm*—Osha Liang LLP

(57) ABSTRACT

A light emitting device drive circuit includes: a power conversion unit for receiving an input electric power and performing an electric power conversion on the input electric power in accordance with a control signal so as to generate the predetermined output current; a current detection unit for detecting an output current IL of the power conversion unit; a temperature detection unit for detecting a case internal temperature TD, which is an interior temperature of a case for accommodating the light emitting device drive circuit; a regulation unit being operable to a) detect whether a temperature TL of the light emitting device has reached a first predetermined temperature TLmax based on TD, IL, and a temperature rise coefficient α relative to IL, the temperature rise coefficient α being set in advance so that TL satisfies a relationship of TL=TD+α·IL, and b) generate a regulation signal for reducing a predetermined output current IL0 so that TL does not exceed TLmax in the event that a result of the detection indicates that TL has reached TLmax; and a control unit for controlling IL0 in accordance with the regulation signal from the regulation unit.

9 Claims, 5 Drawing Sheets

FOREIGN PATENT DOCUMENTS

| | | | |
|---|---|---|---|
| KR | 2005-0001768 | A | 1/2005 |
| KR | 2005-38556 | | 4/2005 |
| KR | 2006-0049480 | A | 5/2006 |
| KR | 0797750 | | 1/2008 |

OTHER PUBLICATIONS

Patent Abstracts of Japan, Publication No. 2004-276738 dated Oct. 7, 2004, 2 pages.

English abstract of KR20050001768 published Jan. 7, 2005, esp@cenet database, 1 page.

English abstract of JP2003272210 published Sep. 26, 2003, esp@cenet database, 1 page.

Notification of Reason for Refusal issued in Korean Application No. Oct. 2007-0137565 dated Sep. 29, 2009 and English translation thereof, 14 pages.

Office Action issued in German Application No. 10 2007 061 921.0-31 dated Oct. 16, 2009 and English translation thereof, 7 pages.

(°C)
A B C D
TA
TIME (°C)
150
140
TL
20
TIME (°C)
110
TD
80
TIME (V)
Sx
TIME (A)
IL
0.7
0.4
0.3
0
TIME

LIGHT EMITTING DEVICE DRIVE CIRCUIT AND VEHICLE LAMP USING THE SAME

This application is based on and claims priority from Japanese Patent Application No. 2006-352766, filed on Dec. 27, 2006, the entire contents of which are hereby incorporated by reference.

BACKGROUND OF INVENTION

1. Field of the Invention

The present disclosure relates to a drive circuit for driving a light emitting device and a vehicle lamp using the light emitting device drive circuit.

2. Background Art

In recent years, semiconductor light emitting devices such as LEDs (light emitting diodes) and LDs (laser diodes) have been in use as light sources for vehicle lamps. Vehicle lamps include drive circuits for supplying stable current to semiconductor light emitting devices in order to drive the semiconductor light emitting devices.

While there may be a case where the temperature of a vehicle lamp is increased by natural environmental factors such as outside air temperature and sunlight, as well as heat radiated from the engine in the engine bay, in a semiconductor light emitting device, in the event that the temperature thereof exceeds its maximum rated temperature, deterioration in luminance progresses rapidly. In other words, the life of the semiconductor light emitting device is decreased. Accordingly, in a drive circuit described in Patent Document No. 1, the temperature of a vehicle lamp or preferably, a temperature in a location lying in the vicinity of a semiconductor light emitting device, is detected and a current that is supplied to the semiconductor light emitting device is decreased based on the temperature so detected. By doing so, a rise in temperature of the semiconductor light emitting device being thereby suppressed. (see, e.g., Japanese Unexamined Patent Document: JP-A-2004-276738)

However, there are some models in which it becomes difficult to dispose the drive circuit in the vicinity of the semiconductor light emitting device. In this case, wiring is necessary to connect a temperature detecting device disposed in the vicinity of the semiconductor light emitting device to the drive circuit and space to dispose the temperature detecting device and a fixing member for the relevant device are also necessary, whereby the production cost of the relevant vehicle lamp is increased. In order to avoid such an increase in the production cost, the temperature of the semiconductor light emitting device could be estimated by detecting an output voltage of the drive circuit as a forward voltage of the semiconductor light emitting device, however, in detection of an absolute value of the voltage, the detection accuracy is decreased due to variation in forward voltage of individual semiconductor light emitting devices. On the other hand, in detection of a relative value of the voltage, although the decrease in detection accuracy attributed to the variation in forward voltage in the individual semiconductor devices can be suppressed to a lower level, the forward voltage of the semiconductor device needs to be stored in advance. As a result, memory and a peripheral circuit become necessary, and this raises again the issue of increase in the production cost of the vehicle lamp.

SUMMARY OF INVENTION

One or more embodiments of the present invention provide a light emitting device drive circuit which can reduce restrictions on the layout of the circuit element, so that the temperature of the light emitting device is controlled in such a manner as not to exceed a predetermined temperature and a vehicle lamp using the light emitting device drive circuit.

According to one or more embodiments of the present invention, in a light emitting device drive circuit for supplying a predetermined output current IL0 to a light emitting device to drive the light emitting device, the light emitting device drive circuit comprises:

a power conversion unit for receiving an input electric power and performing an electric power conversion on the input electric power in accordance with a control signal so as to generate the predetermined output current;

a current detection unit for detecting an output current IL of the power conversion unit;

a temperature detection unit for detecting a case internal temperature TD which is an interior temperature of a case for accommodating the light emitting device drive circuit;

a regulation unit being operable to:

a) detect whether or not a temperature TL of the light emitting device has reached a first predetermined temperature TLmax based on TD, IL, and a temperature rise coefficient $\alpha$ in connection with IL, the temperature rise coefficient $\alpha$ being set in advance so that TL satisfies a relationship of $TL=TD+\alpha \cdot IL$, b) generate a regulation signal for reducing IL0 so that TL does not exceed TLmax in the event that a result of the detection indicates that TL has reached TLmax; and a control unit for controlling IL0 in accordance with the regulation signal from the regulation unit.

According to one or more embodiments of the present invention, the regulation unit includes a regulation signal generation unit, the regulation signal generation unit detects whether or not TL has reached TLmax by detecting whether or not TD has reached a second predetermined temperature TDth which is set in advance so as to satisfy a relationship of $TDth=TLmax-\alpha \cdot IL0$, and generates the regulation signal so as to prevent TD from exceeding TDth in the event that a result of the detection indicates that TD has reached TDth.

According to one or more embodiments of the present invention, the regulation unit further includes a temperature decrease detection unit for detecting a decrease in temperature of the light emitting device based on IL and $\alpha$ in the event that IL0 has been decreased, and wherein the regulation signal generation unit regulates the regulation signal so that TD does not exceed a third predetermined temperature TDmax by changing TDth in a range that TDth does not exceed TDmax in accordance with a variation of the decrease in temperature from the temperature decrease detection unit in the event that IL0 has been decreased.

According to one or more embodiments of the present invention, the current detection unit generates a current detection signal in accordance with IL, wherein the temperature detection unit generates a temperature detection signal in accordance with TD, wherein the temperature decrease detection unit includes an amplifier circuit which utilizes the temperature rise coefficient a as an amplification factor and the temperature decrease detection unit generates a temperature decrease signal in which the value of the current detection signal is amplified in the event that the value of the current detection signal has decreased, and wherein the regulation signal generation unit includes:

a comparison signal generation circuit for generating a comparison signal in accordance with TDth and changing the comparison signal in accordance with a variation of the temperature decrease signal; and a regulation signal generation circuit for receiving the comparison signal and the temperature detection signal and generating the regulation signal in which the value of the current detection signal is regulated based on a difference in value between the comparison signal and the temperature detection signal.

According to one or more embodiments of the present invention, a vehicle lamp comprises:

a light emitting device; and a light emitting device drive circuit for supplying a predetermined output current IL0 to a light emitting device to drive the light emitting device, the light emitting device drive circuit comprising:

a power conversion unit for receiving an input electric power and performing an electric power conversion on the input electric power in accordance with a control signal so as to generate the predetermined output current;

a current detection unit for detecting an output current IL of the power conversion unit;

a temperature detection unit for detecting a case internal temperature TD which is an interior temperature of a case for accommodating the light emitting device drive circuit;

a regulation unit being operable to:

a) detect whether or not a temperature TL of the light emitting device has reached a first predetermined temperature TLmax based on TD, IL and a temperature rise coefficient $\alpha$ in connection with IL, the temperature rise coefficient $\alpha$ being set in advance so that TL satisfies a relationship of $TL=TD+\alpha \cdot IL$, b) generate a regulation signal for reducing IL0 so that TL does not exceed TLmax in the event that a result of the detection indicates that TL has reached TLmax; and a control unit for controlling IL0 in accordance with the regulation signal from the regulation unit.

According to one or more embodiments of the present invention, a vehicle lamp comprises.

a light emitting device; and a light emitting device drive circuit for supplying a predetermined output current IL0 to a light emitting device to drive the light emitting device, the light emitting device drive circuit comprising:

a power conversion unit for receiving an input electric power and performing an electric power conversion on the input electric power in accordance with a control signal so as to generate the predetermined output current;

a current detection unit for detecting an output current TL of the power conversion unit;

a temperature detection unit for detecting a case internal temperature TD which is an interior temperature of a case for accommodating the light emitting device drive circuit;

a regulation unit being operable to:

a) detect whether or not a temperature TL of the light emitting device has reached a first predetermined temperature TLmax based on TD, IL and a temperature rise coefficient a in connection with IL, the temperature rise coefficient $\alpha$ being set in advance so that TL satisfies a relationship of $TL=TD+\alpha \cdot IL$, b) generate a regulation signal for reducing IL0 so that TL does not exceed TLmax in the event that a result of the detection indicates that TL has reached TLmax; and a control unit for controlling IL0 in accordance with the regulation signal from the regulation unit, wherein the regulation unit includes a regulation signal generation unit, the regulation signal generation unit detects whether or not TL has reached TLmax by detecting whether or not TD has reached a second predetermined temperature TDth which is set in advance so as to satisfy a relationship of $TDth=TLmax-\alpha \cdot IL0$, and generates the regulation signal so as to prevent TD from exceeding TDth in the event that a result of the detection indicates that TD has reached TDth, wherein the regulation unit further includes a temperature decrease detection unit for detecting a decrease in temperature of the light emitting device based on IL and $\alpha$ in the event that IL0 has been decreased, and wherein the regulation signal generation unit regulates the regulation signal so that TD does not exceed a third predetermined temperature TDmax by changing TDth in a range that TDth does not exceed TDmax in accordance with a variation of the decrease in temperature from the temperature decrease detection unit in the event that IL0 has been decreased, wherein the current detection unit generates a current detection signal in accordance with IL, wherein the temperature detection unit generates a temperature detection signal in accordance with TD, wherein the temperature decrease detection unit includes an amplifier circuit which utilizes the temperature rise coefficient $\alpha$ as an amplification factor and the temperature decrease detection unit generates a temperature decrease signal in which the value of the current detection signal is amplified in the event that the value of the current detection signal has decreased, and wherein the regulation signal generation unit includes:

a comparison signal generation circuit for generating a comparison signal in accordance with TDth and changing the comparison signal in accordance with a variation of the temperature decrease signal; and a regulation signal generation circuit for receiving the comparison signal and the temperature detection signal and generating the regulation signal in which the value of the current detection signal is regulated based on a difference in value between the comparison signal and the temperature detection signal.

According to one or more embodiments of the present invention, a light emitting device drive circuit, which can reduce the restrictions on the layout of the circuit element, so that the temperature of the light emitting device is controlled in such a manner as not to exceed the predetermined temperature, and a vehicle lamp, which includes the light emitting device drive circuit can be obtained.

Other aspects and advantages of the invention will be apparent from the following description, the drawings and the claims.

DETAILED DESCRIPTION

Figure 1:
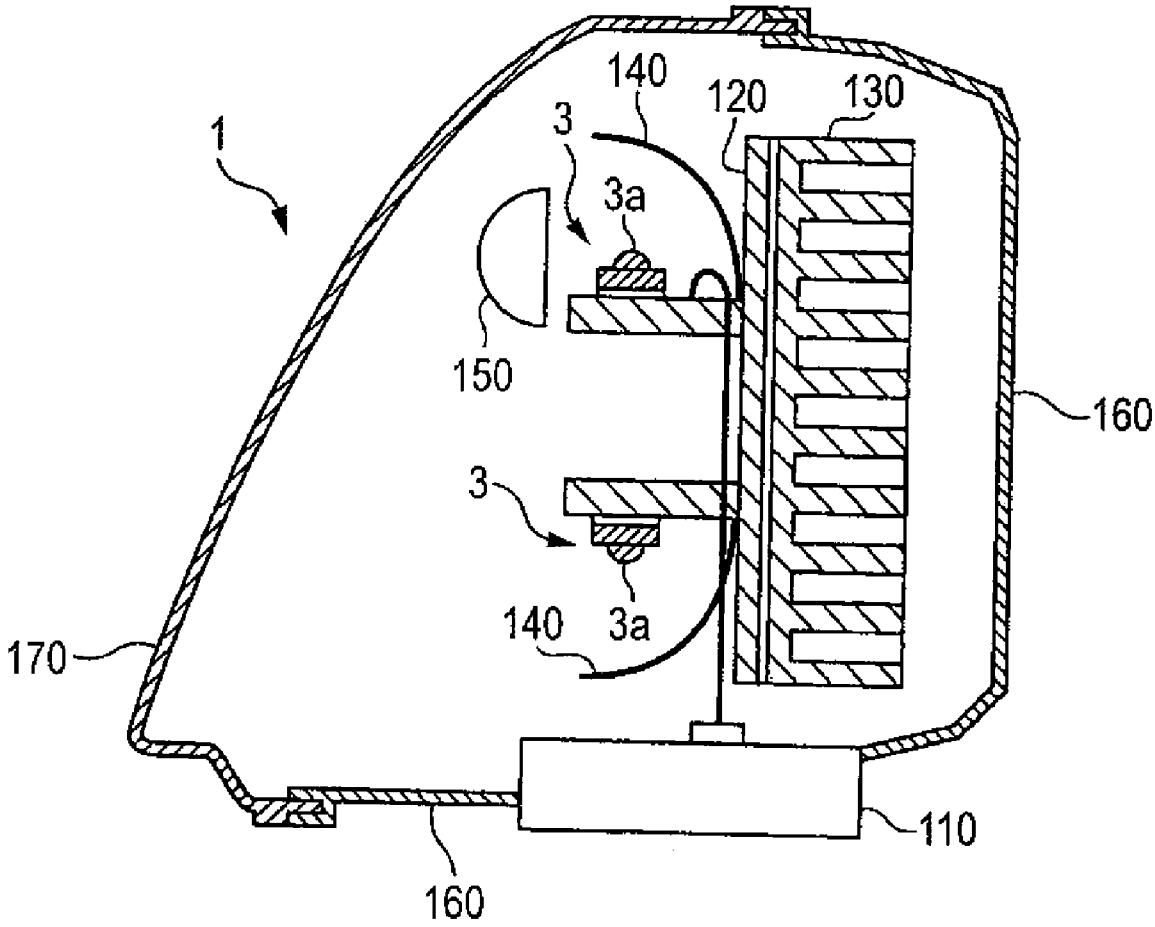
FIG. 1 is a sectional view showing a vehicle lamp according to an embodiment of the present invention.

Hereinafter, embodiments of the invention will be described in detail with reference to the drawings. Note that in the respective drawings, like reference numerals will be given to like or corresponding portions.

FIG. 1 is a sectional view of a vehicle lamp 1 according to one or more embodiments of the invention. The lamp 1 shown in FIG. 1 is a lamp, which is used mainly for a headlamp of a vehicle, and includes a light emitting device 3, a case 110 for accommodating a light emitting device drive circuit, a bracket 120, a heat sink 130, a reflector 140, a lens 150, a lamp body 160, and a full-face cover 170.

The light emitting device 3 is a semiconductor light emitting device such as an LED (light emitting diode) or LD (laser diode). The light emitting device 3 is supported on the bracket 120, and the heat sink 130 for heat dissipation is provided on the bracket 120. The light emitting device 3 outputs light from light output windows 3*a* towards the reflector 140. The reflector 140 is supported on the bracket 120 and corrects output light from the light emitting device 3 so as to emit the light so corrected to the front of the vehicle via the full-face cover 170. Note that the light collected by the reflector 140 may be collected further via the lens 150 for emission to the front of the vehicle.

The light emitting device 3, the bracket 120, the heat sink 130, the reflector 140 and the lens 150 are disposed within a lamp compartment, which is covered by the lamp body 160 and the full-face cover 170. In addition, the case 110 for accommodating the light emitting device drive circuit for the light emitting device 3 is brought into engagement with the lamp body 160. In one or more embodiments, aluminum (Al), which has superior heat dissipation properties, is used as a material for the case 110. In addition, in one or more embodiments, although part of the case 110 is brought into engagement with the lamp body 160 in such a manner as to project outwards of the lamp compartment, there may be a case where the whole of the case is disposed within the lamp compartment.

Figure 2:
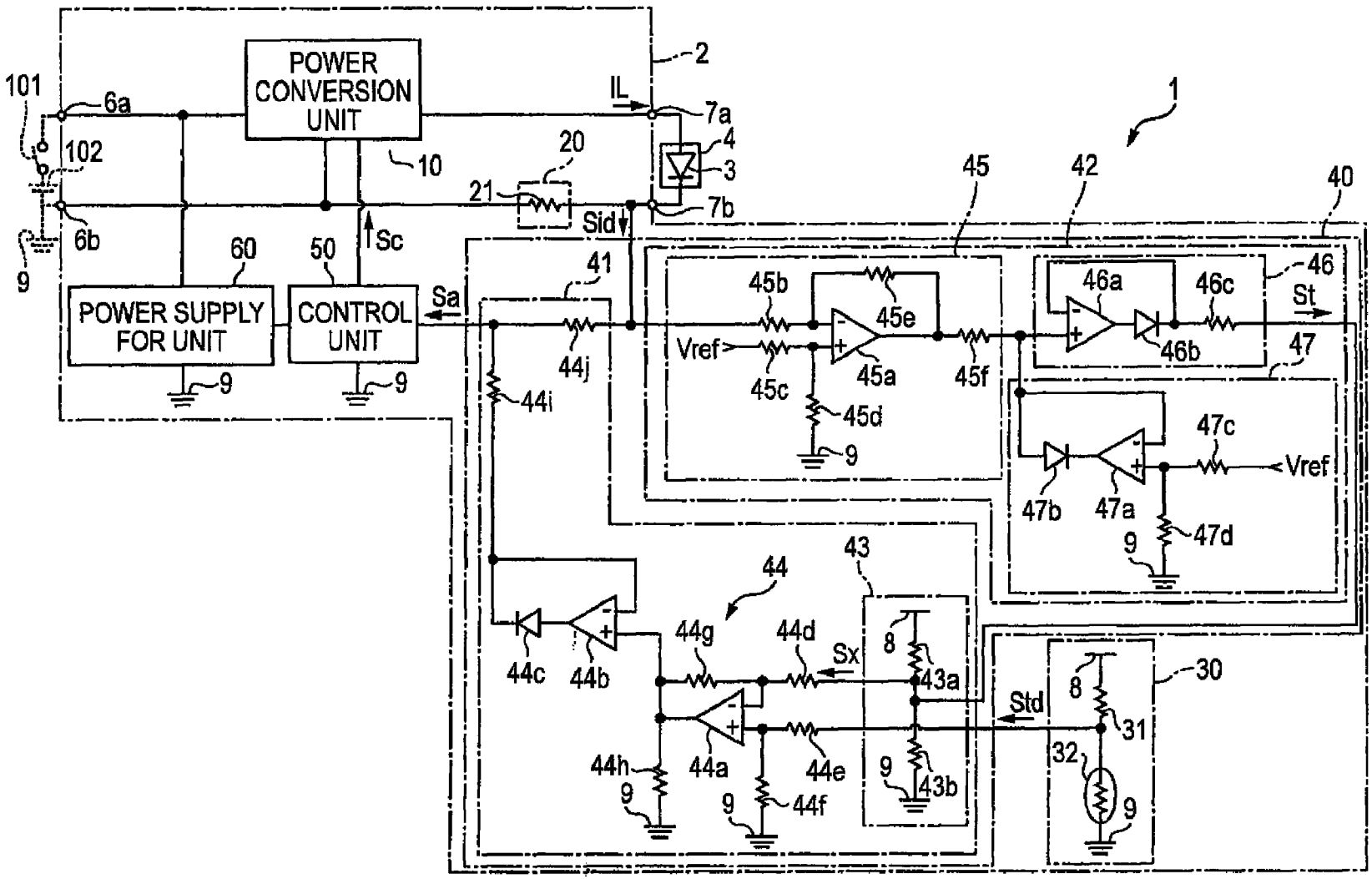
FIG. 2 is a circuit diagram showing a light emitting device drive circuit according to the embodiment of the present invention.

Next, a light emitting device drive circuit 2 will be described. FIG. 2 is a circuit diagram showing a light emitting device drive circuit according to one or more embodiments of the present invention. In FIG. 2, a switch 101 and a battery 102 as an input direct-current power supply are shown together with the light emitting device drive circuit 2.

The switch 101 and the battery 102 are connected in series between a pair of input terminals 6*a*, 6*b* of the light emitting device drive circuit 2, and the input terminal 6*b* is connected to a power supply line (for example, a grounded line) 9. A socket 4 is connected between a pair of output terminals 7*a*, 7*b* of the light emitting device drive circuit 2, and the light emitting device 3 is mounted in the socket 4. Accordingly, the light emitting device drive circuit 2 illuminates the light emitting device 3 using a direct-current electric power that is supplied from the battery 102 while the switch 101 is in an "on" state. In addition, in general, a plurality of light emitting devices 3 is connected in series between the pair of output terminals 7*a*, 7*b* of the light emitting device drive circuit 2.

The light emitting device drive circuit 2 has a power conversion unit 10, a current detection unit 20, a temperature detection unit 30, a regulation unit 40, a control unit 50, and a power supply 60 for the control unit.

The power conversion unit 10 is a switching type regulator of, for example, a PWM (Pulse Width Modulation) mode. In response to a pulse-like control signal Sc from the control unit 50, performs an electric power conversion on a direct-current electric power that is input into the input terminals 6*a*, 6*b* from the battery 102, so as to generate a predetermined output current IL, which is a constant current value in the output terminals 7*a*, 7*b*, in order to maintain the luminance of the light emitting device 3 at a constant level.

The current detection unit 20 is connected in series between the output terminal 7*b* and the power supply line 9 and includes a current detection resistance element 21. The current detection unit 20 outputs a voltage drop that is generated in the current detection resistance element 21 according to the output current IL to the regulation unit 40 as a current detection signal Sid.

The temperature detection unit 30 has a temperature detection element such as a thermistor and detects an internal temperature of the case 110 of the light emitting device drive circuit 2. In one or more embodiments, the temperature detection unit 30 has a large heat value and detects a circuit internal temperature (which indicates an interior temperature in the case 110 of the light emitting device drive circuit 2) in the vicinity of the power conversion unit 10, which has a low maximum rated temperature as an internal temperature of the case 110. Specifically, the temperature detection unit 30 has a resistance element 31 and a thermistor 32, which are connected in series between a constant power supply line 8 and the power supply line 9, and outputs a divided voltage between the resistance element 31 and the thermistor 32 to the regulation unit 40 as a temperature detection signal Std.

In addition, in the event that the case 110 is made to open to the lamp compartment or does not exist (in which case, the light emitting device drive circuit 2 is placed in such a manner as to be exposed in the lamp compartment), the temperature detection unit 30 may only have to detect an internal temperature of the lamp compartment, which is covered by the lamp body 160 and the full-surface cover 170, in place of the internal temperature of the case 110. That is, the temperature detection signal Std of the temperature detection unit 30 may be a value which indicates the temperature of the constituent part of the light emitting device drive circuit 2 or a temperature in a location lying in the vicinity of the relevant part in the interior of the lamp compartment.

The regulation unit 40 detects whether or not a temperature TL of the light emitting device 3 has reached a maximum rated temperature (a first predetermined temperature) TLmax of the light emitting device 3 based on the current detection signal Sid from the current detection unit 20 and the temperature detection signal Std from the temperature detection unit 30 and generates a regulation signal Sa for decreasing a predetermined output current so that TL does not exceed TLmax in the event that a result of the detection indicates that TL has reached TLmax for output to the control unit 50. The regulation unit 40 will be described in detail later.

The control unit 50 uses an output voltage from the power supply 60 as a power supply. The power supply 60 is, for example, a series regulator and supplies an output voltage in which a direct-current voltage from the battery 102 that is input into the input terminals 6*a*, 6*b* is stabilized to the control unit 50. The control unit 50 generates a pulse-like control signal Sc for maintaining the predetermined output current at a constant level in response to the regulation signal 40*a* from the regulation unit 40 and changes the pulse width of the control signal Sc to decrease the predetermined output current in the event that TL has reached TLmax.

Next, the regulation unit 40 will be described. The regulation unit 40 has a regulation signal generation unit 41 and a temperature decrease detection unit 42.

The regulation signal generation unit 41 detects whether or not TL has reached TLmax by detecting an internal temperature TD of the case 110 detected by the temperature detection unit 30 has reached a predetermined temperature (a second predetermined temperature) TDth and generates a regulation signal Sa for decreasing the predetermined output current so that TL does not exceed TLmax in the event that a result of the detection indicates that TL has reached TLmax. Accordingly, the regulation signal generation unit 41 has a comparison signal generation circuit 43 and a regulation signal generation circuit 44.

The comparison signal generation circuit 43 has resistance elements 43*a*, 43*b*, which are connected in series between the constant power supply line 8 and the power supply line 9, and outputs a divided voltage between the resistance element 43*a* and the resistance element 43*b* to the regulation signal generation circuit 44 as a comparison signal Sx.

The regulation signal generation circuit 44 has operational amplifiers or OP amplifiers 44*a*, 44*b*, a diode 44*c*, and resistance elements 44*d*, 44*e*, 44*f*, 44*g*, 44*h*, 44*i*, 44*j*. The comparison signal Sx from the comparison signal generation circuit 43 is input into a negative input terminal of the OP amplifier 44*a* via the resistance element 44*d*, while a temperature detection signal Std, which is a divided voltage between the resistance elements 44*e*, 44*f*, is input into a positive input terminal of the OP amplifier 44. The negative input terminal of the OP amplifier 44*a* is connected to an output terminal via the resistance element 44*g*, and the resistance element 44*h* is connected between the output terminal and a power supply line 9. In addition, the output terminal of the OP amplifier 44*a* is connected to a positive input terminal of the OP amplifier 44*b*.

A negative input terminal of the OP amplifier 44*b* is connected to a cathode of the diode 44*c*, and an output terminal of the OP amplifier 44*b* is connected to an anode of the diode 44*c*. The cathode of the diode 44*c* is connected to one end of the resistance element 44*i*, and the other end of the resistance element 44*i* is connected to the control unit 50. In addition, the current detection signal Sid from the current detection unit 20 is input into one end of the resistance element 44*j*, and the other end thereof is connected to the other end of the resistance element 44*i* and the control unit 50.

The voltage value of the comparison signal Sx of the comparison signal generation circuit 43 is set in advance to a voltage value that conforms to a predetermined temperature TDth of the light emitting device drive circuit 2, which satisfies Equation (1) below.

$$TDth = TL\max - \alpha \cdot IL0 \quad (1)$$

where TLmax denotes a maximum rated temperature of the light emitting device 3, and IL0 denotes a predetermined output current value of the power conversion unit 10. In addition, α denotes a temperature rise coefficient relative to the current of the light emitting device 3, which satisfies Equation (2) below.

$$TL = TD + \alpha \cdot IL \quad (2)$$

where

TL: the temperature of the light emitting device 3;

TD: an internal temperature of the case 110, i.e., the temperature of the light emitting device drive circuit 2; and IL: a current which flows to the light emitting device, i.e., an output current of the light emitting device drive circuit 2.

In other words, the voltage value of the comparison signal Sx of the comparison signal generation circuit 43 is a voltage value, which conforms to the predetermined temperature TDth of the light emitting device drive circuit 2 that results when the temperature TL of the light emitting device 3 is the maximum rated temperature TLmax, and, in this embodiment, the voltage value of the comparison signal Sx is set to a divided voltage value of the temperature detection signal Std of the temperature detection unit 30 when the temperature TL of the light emitting device 3 is the maximum rated temperature TLmax.

The regulation signal generation circuit 44 is set in advance so that the voltage value of the cathode of the diode 44*c* is less than the voltage value of the current detection signal Sid when the divided voltage of the temperature detection signal Std is less than the voltage value of the comparison signal Sx (i.e., when the internal temperature TD of the case 110 of the light emitting device drive circuit 2 is less than the predetermined temperature TDth) and outputs the current detection signal Sid as a regulation signal Sa. On the other hand, when the divided voltage value of the temperature detection signal Std is equal to or larger than the comparison signal Sx (i.e., when the internal temperature TD of the case 110 of the light emitting device drive circuit 2 is equal to or larger than the predetermined temperature TDth), the voltage of the cathode of the diode 44*c* is equal to or larger than the voltage value of the current detection signal Sid, and the regulation signal generation circuit 44 outputs a regulation signal Sx such that a cathode voltage of the diode 44*c* is added to the current detection signal Sid via the resistance element 44*i*.

Accordingly, the regulation signal generation unit 41 detects that the internal temperature TD of the case 110 of the light emitting device drive circuit 2 has reached the predetermined temperature TDth by detecting that the divided voltage value of the temperature detection signal Std has reached the voltage value of the comparison signal Sx and changes the voltage value of the regulation signal Sa based on the result of the detection to thereby decrease the predetermined output current so that the internal temperature TD of the case 110 of the light emitting device drive circuit 2 does not exceed the predetermined temperature TDth. Because the predetermined temperature TDth is the internal temperature TD of the case 110 of the light emitting device drive circuit 2 that results when the light emitting device 3 has reached the maximum rated temperature TLmax, the regulation signal generation unit 41 decreases the predetermined output current so that the temperature TL of the light emitting device 3 does not exceed the maximum rated temperature TLmax.

Next, the temperature decrease detection unit 42 detects a decrease in temperature of the light emitting device 3 when the predetermined output current of the power conversion unit 10 is decreased by the regulation signal generation unit 41. Accordingly, the temperature decrease detection unit 42 has two amplifier circuits 45, 46 and a current attraction circuit 47.

The amplifier circuit 45 has an OP amplifier 45*a* and resistance elements 45*b*, 45*c*, 45*d*, 45*e*, 45*f*. The current detection signal Sid is input into a positive input terminal of the OP amplifier 45*a* via the resistance element 45*b*, and a reference voltage Vref, which is divided by the resistance elements 45*c*, 45*d*, is input into a positive input terminal thereof The resistance element 45*e* is connected between the negative input terminal and an output terminal of the OP amplifier 45*a*, and the output terminal is connected the amplifier circuit 46 and the current attraction circuit 47 via the resistance element 45*f*.

The amplifier circuit 46 has an OP amplifier 46*a*, a diode 46*b* and a resistance element 46*c*. An output voltage of the amplifier circuit 45 is input into a positive input terminal of the OP amplifier 46*a*, and a negative input terminal thereof is connected to a cathode of the diode 46*b*. An output terminal of the OP amplifier 46*a* is connected to an anode of the diode 46*b*. The cathode of the diode 46*b* is connected is connected to a node between the resistance element 43*a* and the resistance element 43*b* of the comparison signal generation circuit 43 in the regulation signal generation unit 41 via the resistance element 46*c*.

A total sum of an amplification factor of the amplifier circuit 45 and an amplification factor of the amplifier circuit 46 is set in advance so as to constitute a temperature rise coefficient $\alpha$ relative to the current of the light emitting device 3. In addition, the voltage value of a temperature decrease signal St which is output from the amplifier circuit 46 is set in advance so as to coincide with the voltage value of the comparison signal Sx from the comparison signal generation circuit 43 when an output current IL of the light emitting device drive circuit 2 is a predetermined output current value.

Accordingly, the amplifier circuit 45 and the amplifier circuit 46 generate a temperature decrease signal St, which coincides with the voltage value of the comparison signal Sx of the comparison signal generation circuit 43 when the output current IL of the light emitting device drive circuit 2 is the predetermined output current and generates, when the output current IL is decreased below the predetermined output current, a temperature decrease signal St in which a voltage decrease amount of the current detection signal Sid from the current detection unit 20 is amplified by a multiplier of the temperature rise coefficient a for rise. That is, the amplifier circuit 45 and the amplifier circuit 46 generate a temperature decrease signal St, which has a variation that conforms to a temperature decrease amount due to a decrease in current of the light emitting device 3, whereby the temperature decrease detection unit 42 raises the voltage value of the comparison signal Sx of the comparison signal generation circuit 43 (i.e., the predetermined temperature TDth of the light emitting device drive circuit 2) according to the temperature decrease amount due to the decrease in current of the light emitting device 3.

Next, the current attraction circuit 47 has an OP amplifier 47*a*, a diode 47*b* and resistance elements 47*c*, 47*d*. A reference voltage Vref, which is divided by the reference elements 47*c*, 47*d*, is input into a positive input terminal of the OP amplifier 47*a*, and a negative input terminal thereof is connected to an anode of the diode 47*b*. An output terminal of the OP amplifier 47*a* is connected to a cathode of the diode 47*b*.

The current attraction circuit 47 attracts current when the value of an output voltage of the amplifier 45 rises above a voltage value that is generated when the internal temperature TD of the case 110 of the light emitting device drive circuit 2 reaches the maximum rated temperature (a third predetermined temperature) TDmax. Accordingly, the current attraction circuit 47 sets an upper limit value of the rise in the predetermined temperature TDth by the amplifier circuits 45, 46 to the maximum rated temperature TDmax.

Next, the operations of the vehicle lamp 1 and the light emitting device drive circuit 2. Firstly, when the switch 101 is put in an "on" state by the driver of the vehicle, so that a direct-current electric power is input to the pair of input terminals 6*a*, 6*b* from the battery 102, a power supply voltage is supplied to the control unit 50 by the power supply 60, and a control signal Sc is output from the control unit 50. Then, an electric power conversion is implemented on the direct-current electric power from the battery 102, so that an output current IL is supplied to the light emitting device 3 which is connected to the pair of output terminals 7*a*, 7*b*.

When the environment temperature of the vehicle lamp 1 is low and the internal temperature TD of the case 110 of the light emitting device drive circuit 2 is lower than the predetermined temperature TDth, which is 80 degrees C. (i.e., when the divided voltage value of the temperature detection signal Std from the temperature detection unit 30 is smaller than the voltage value of the comparison signal Sx from the comparison signal generation module 43), the voltage of the cathode of the diode 44*c* is smaller than the voltage value of the current detection signal Sid from the current detection unit 20, and in the regulation signal generation unit 41, the current detection signal Sid is output as the regulation signal Sa. Then, the output current IL is controlled by the control unit 50 in such a manner as to become a predetermined output current value IL0, which is, for example, 0.7 A.

Figures 3A, 3B, 3C, 3D, 3E:
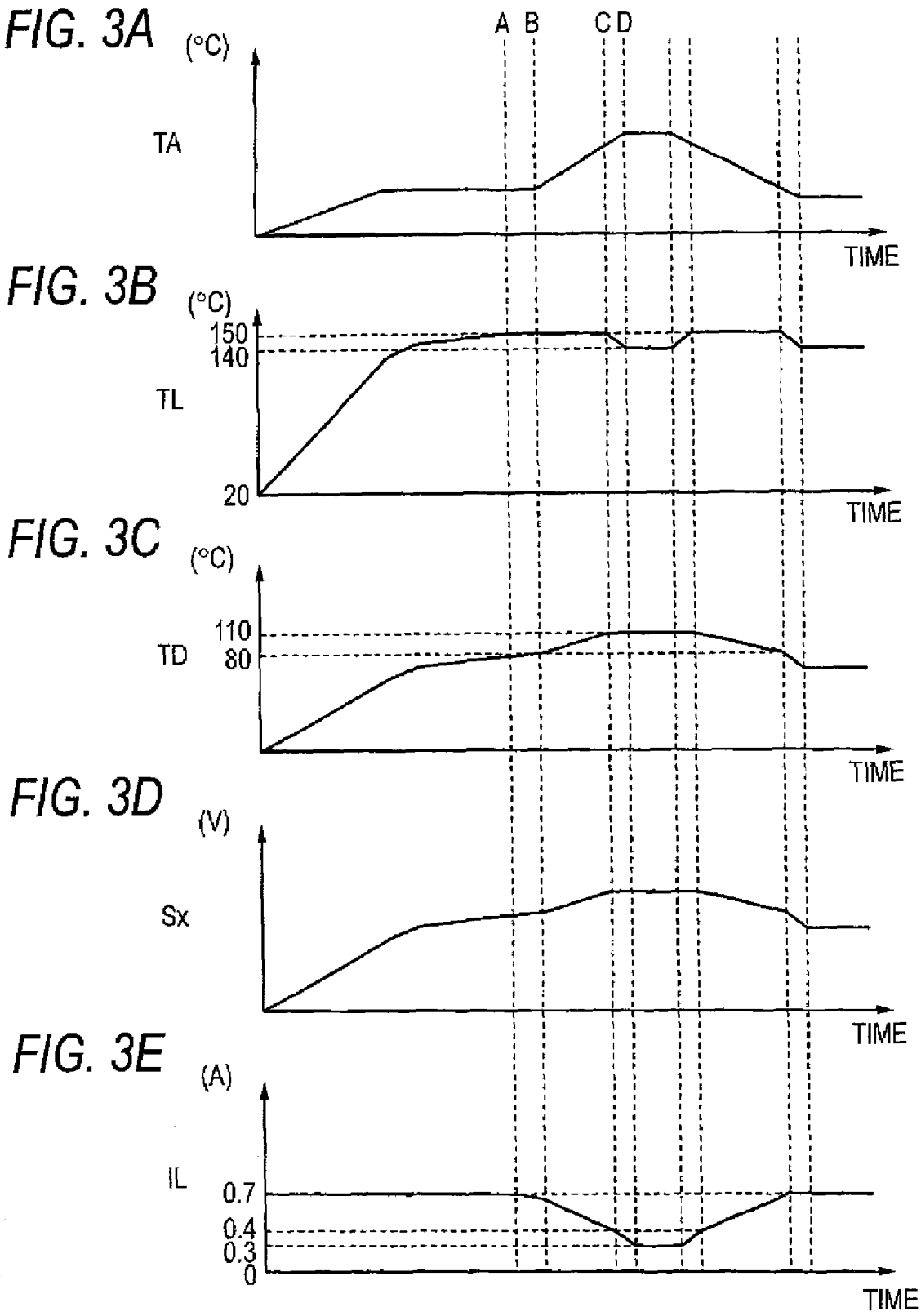
FIGS. 3A to 3E are charts showing waveforms of respective portions of the light emitting device drive circuit shown in FIG. 2.

FIGS. 3A to 3E show waveforms of respective portions of the light emitting device drive circuit 2 shown in FIG. 2. As is shown in FIG. 3A, when the environment temperature of the vehicle lamp 1 is raised by the environmental factors such as outside air temperature and sunlight and heat radiated from the engine in the engine bay, the temperature TL of the light emitting device 3 and the internal temperature of the case 110 of the light emitting device drive circuit 2 are raised Rigs. 3B and 3C). Thereafter, the temperature TL of the light emitting device 3 reaches the maximum rated temperature (the first predetermined temperature) TLmax, which is 150 degrees C. at a point in time A. As this occurs, the internal temperature TD of the case 110 of the light emitting device drive circuit 2 reaches the predetermined temperature TDth, which is 80 degrees C.

On the other hand, when the internal temperature TD of the case 110 of the light emitting device drive circuit 2 rises, the divided voltage value of the temperature detection signal Std from the temperature detection unit 30 rises, and the divided voltage value of the temperature detection signal Std reaches the voltage value of the comparison signal Sx at the point in time A, and the voltage value of the cathode of the diode 44*c* reaches the voltage value of the current detection signal Sid. Then, in the regulation signal generation unit 41, the cathode voltage of the diode 44*c* is output via the resistance element 44*i* as the regulation signal Sa in such a state that it is added to the current detection signal Sid, and the output current IL begins to be decreased by the control unit 50 from the predetermined output current value IL, which is 0.7 A (a point in time A in FIG. 3E).

Accordingly, the regulation signal generation unit 41 starts to control so that the internal temperature TD of the case 110 of the light emitting device drive circuit 2 does not exceed the predetermined temperature TDth, which is 80 degrees C. by decreasing the self-heat value of the light emitting device drive circuit 2 (a point in time A in FIG. 3C). As a result the self-heat value of the light emitting device 3 is decreased, whereby the temperature TL of the light emitting device 3 begins to be controlled so that the temperature TL does not exceed the maximum rated temperature TLmax, which is 150 degrees C. (a point in time A in FIG. 3B).

Thus, when the environment temperature TA of the vehicle lamp 1 rises for the reasons described above (a time period B to D in FIG. 3A), because the internal temperature TD of the case 110 of the light emitting device drive circuit 2 has not yet reached the maximum rated temperature (the third predetermined temperature) TDmax, which is 110 degrees C., it is not efficient that the internal temperature TD of the case 110 of the light emitting device drive circuit 2 is controlled not to exceed the predetermined temperature TDth, which is 80 degrees C.

In one or more embodiments, when the output current RL is decreased from the predetermined output current value IL0, which is 0.7 A, by the regulation signal generation unit 41, whereby the voltage value of the current detection signal Sid is decreased, the voltage value of the temperature decrease detection signal St from the temperature decrease detection unit 42 rises, and the voltage of the comparison signal Sx rises (a time period B to C in FIG. 3D), whereby the decrease amount of the output current IL by the regulation signal generation unit 41 is suppressed, the rise in the temperature TL of the light emitting device 3 is prevented without suppressing the rise in the internal temperature TD of the case 110 of the light emitting device drive circuit 2 (time periods B to C in FIGS. 3B and 3C).

In the temperature decrease detection unit 42, when the voltage value of the temperature decrease detection signal St rises to a voltage value which indicates the maximum rated temperature TDmax, which is 110 degrees C., the rise in the output voltage of the amplifier circuit 45 is stopped by the attraction of current by the current attraction circuit 47, and the rise in the voltage value of the temperature decrease signal St is stopped, whereby the rise in the voltage value of the comparison signal Sx is stopped, and the decrease amount of the output current IL by the regulation signal generation unit 41 is increased (a time period C to D in FIG. 3E), the internal temperature TD of the case 110 of the light emitting device drive circuit 2 being controlled in such a manner as not to exceed the maximum rated temperature TDmax, which is 110 degrees C. (a time period C to D in FIG. 3C). As this occurs, the temperature TL of the light emitting device 3 is decreased from the maximum rated temperature TLmax, which is 150 degrees C. (a time period C to D in FIG. 3B).

In one or more embodiments, assuming that the temperature rise coefficient a equals 100, it is understood from Equation (2) above that when the output current IL is decreased to 0.4 A, the internal temperature of the case 110 of the light emitting device drive circuit 2 reaches the maximum rated temperature TDmax, which is 110 degrees (a point in time C in FIG. 3C).

$$TD=150-100\times0.4=110 \text{ degrees C.}$$

In addition, the output current is decreased so that the internal temperature of the case 110 of the light emitting device drive circuit 2 does not exceed the maximum rated temperature TDmax, which is 110 degrees C., and, for example, when the output current IL is decreased to 0.3 A at a point in time D, this means that the temperature TL of the light emitting device 3 is decreased to 140 degrees C.

$$TL=110+100\times0.3=130 \text{ degrees C.}$$

Accordingly, the internal temperature TD of the case 110 of the light emitting device drive circuit 2 (i.e., the temperature of the light emitting device drive circuit itself) is detected without disposing a temperature detection element in the vicinity of the light emitting device 3, whereby the temperature TL of the light emitting device 3 can be controlled in such a manner as not to exceed the maximum rated temperature TLmax of the light emitting device 3 by reducing the restrictions on the layout of the temperature detection element (the circuit element). As a result, the reduction in the life of the light emitting device can be suppressed.

In addition, when the output current IL is decreased below the predetermined output current value IL0, the temperature of the light emitting device drive circuit itself can also be controlled in such a manner as not to exceed maximum rated temperatures of the interior parts of the circuit. As a result, the reduction in the lives of the interior parts of the light emitting device drive circuit 2 can be suppressed, and the operation of the light emitting device drive circuit 2 can be stabilized.

In addition, according to the light emitting device drive circuit 2 of the embodiment because the regulation unit 40, in particular, the temperature decrease detection unit 42 is made up of the electric circuits such as the amplifier circuits, the resistor elements and the like, the temperature rise coefficient a can easily be changed to be set according to the light emitting device 3 by changing the amplification factor made up of the resistance value of the resistance element 45*b* and the resistance value of the resistance element 45*e* or the resistance value of the resistance element 46*c*.

In addition, in the event that a light emitting device 3 having a temperature rise coefficient $\alpha$=80 to the light emitting device drive circuit 2 of one of more embodiments, although when the output current IL of the light emitting device drive circuit 2 is decreased to 0.4 A, the internal temperature TD of the case 110 of the light emitting device drive circuit 2 is raised to 118 degrees C. from TD=150−80×0.4=118, according to the light emitting device drive circuit 2 of the embodiment, because the temperature decrease detection unit 42 has the current attraction circuit 47, there exists no case where the internal temperature TD of the case 110 of the light emitting device drive circuit 2 exceeds the maximum rated temperature TDmax, which is 110 degrees C. That is, according to the light emitting device drive circuit 2 of the embodiment, with the amplification factor in the temperature decrease detection unit 41 set in advance to a large value, various light emitting devices 3, which have temperature rise coefficients $\alpha$ equal to or smaller than the amplification factor set in advance, can be driven.

Additionally, according to the vehicle lamp 1 of one or more embodiments, because the vehicle lamp 1 includes the light emitting device drive circuit 2, the reduction in the life of the light emitting device 3 can be suppressed, and as a result the reduction in the life of the vehicle lamp 1 can be suppressed.

Note that the present invention is not limited to the embodiments described above. Rather, those skilled in the art will appreciate various modifications that can be made thereto without departing from the spirit of the invention.

While in the embodiments described above, the example has been described in which the temperature rise coefficient $\alpha$ is large to be 100 or 80, so that the temperature TL of the light emitting device 3 reaches the maximum rated temperature TLmax earlier than the internal temperature TD of the case 110 of the light emitting device drive circuit 2 reaches the maximum rated temperature TDmax, one or more embodiments of the present invention can be modified to be applied even to a case where the light emitting device 3 has a small temperature rise coefficient $\alpha$ of 50, so that the internal temperature TD of the case 110 of the light emitting device drive circuit 2 reaches the maximum rated temperature TDmax earlier than the temperature TL of the light emitting device 3 reaches the maximum rated temperature TLmax.

MODIFIED EXAMPLE

Figure 4:
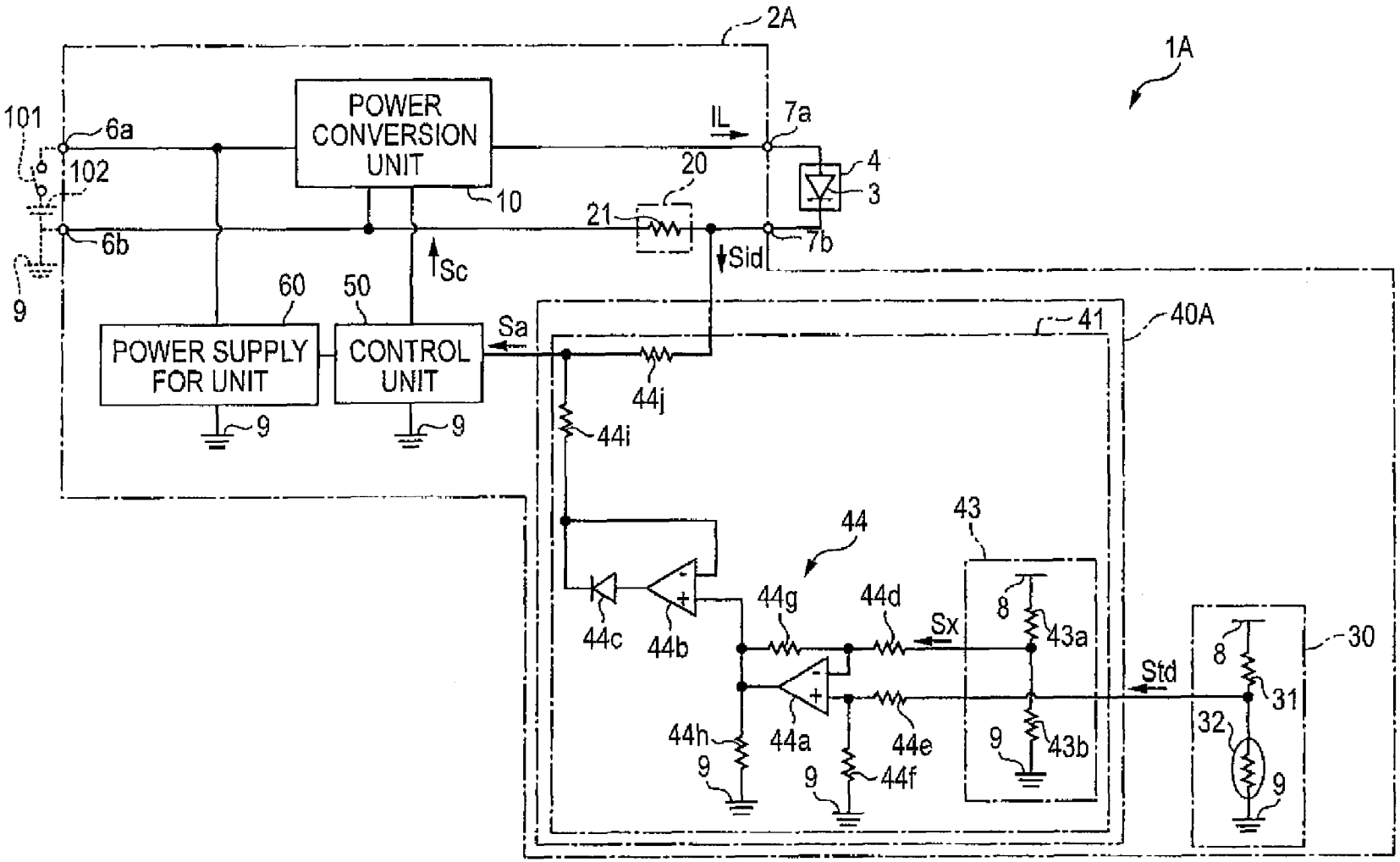
FIG. 4 is a circuit diagram showing an electrical configuration of a vehicle lamp and a light emitting device drive circuit according to a modified example.
Figure 5A:
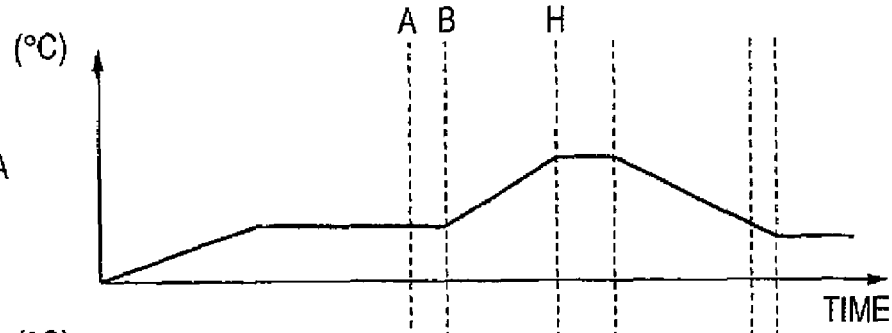
FIGS. 5A to 5D are charts showing waveforms of respective portions of the modified example shown in FIG. 4.
Figure 5B:
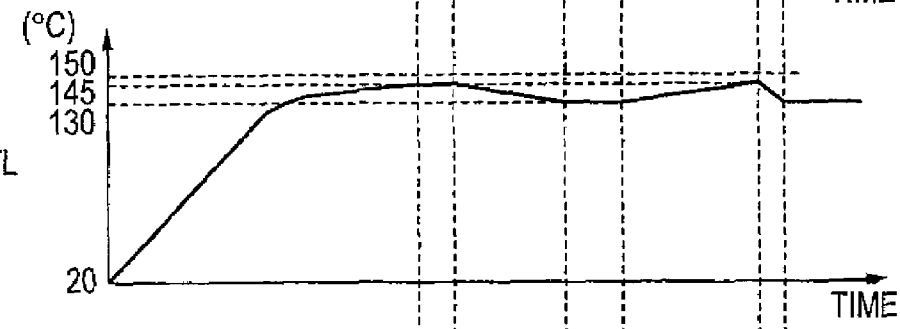
Figure 5C:
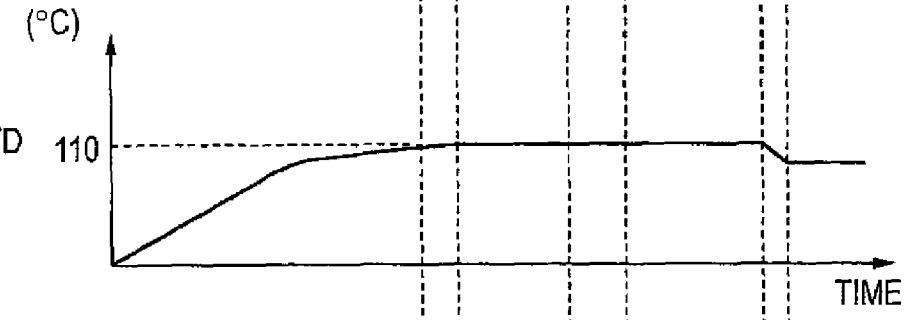
Figure 5D:
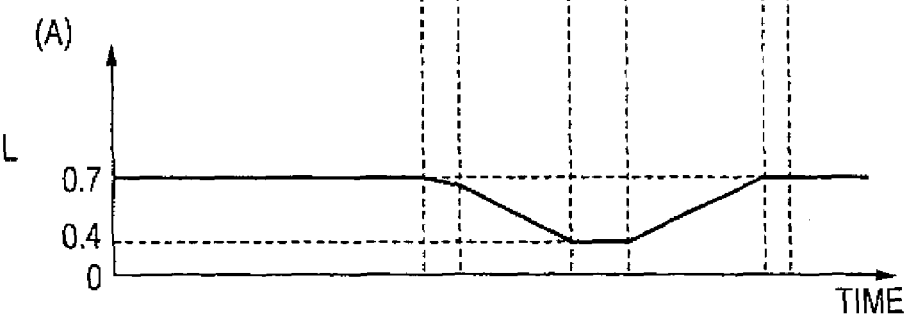

FIG. 4 is a circuit diagram showing an electrical configuration of a vehicle lamp according to a modified example. A vehicle lamp 1A shown in FIG. 4 includes a light emitting device drive circuit 2A according to the modified example in place of the light emitting device drive circuit 2 provided in the vehicle lamp 1. The light emitting device drive circuit 2A has a regulation unit 40A, which replaces the regulation unit 40 of the light emitting device drive circuit 2. The regulation unit 40A differs from the regulation unit 40 of the embodiments above in that the former does not include the temperature decrease detection unit 42.

In this modified example, the voltage value of a comparison signal Sx in a regulation signal generation unit 41 is a voltage value that conforms to a maximum rated temperature TDmax of the light emitting device drive circuit 2A and is set to a divided voltage value of a temperature detection signal St of a temperature detection unit 30 when an internal temperature T of a case 110 of the light emitting device drive circuit 2A is a maximum rated temperature TD max thereof.

Accordingly, in this modified example, the regulation signal generation unit 41 detects that the internal temperature TD of the case 11 of the light emitting device drive circuit 2A has reached the maximum rated temperature TDmax by detecting that the divided voltage value of the temperature detection signal Std has reached the voltage value of the comparison signal Sx, and based on the result of the detection, the regulation signal generation unit 41 changes the voltage of a modulation signal Sa so as to decrease a predetermined output current so that the internal temperature TD of the case 110 of the light emitting device drive circuit 2A does not exceed the maximum rated temperature TDmax. In this modified example, because the light emitting device 3 has a small temperature rise coefficient $\alpha$ of 50, in the event that the internal temperature TD of the case 110 of the light emitting device drive circuit 2A is controlled in such a manner as not to exceed the maximum rated temperature TDmax, the temperature TL of the light emitting device 3 is controlled to be equal to or smaller than 145 degrees C. from TL=110+50×0.7=145, and hence, there exists no case where the temperature TL of the light emitting device 3 exceeds the maximum rated temperature TLmax, which is 150 degrees C.

FIGS. 5A to 5D show waveforms of respective portions of the light emitting device drive circuit of the modified example shown in FIG. 4. When the environment temperature TA of the vehicle lamp 1A rises, the internal temperature TD of the case 110 of the light emitting device drive circuit 2A first reaches the maximum rated temperature TDmax, which is 110 degrees C. As this occurs, the temperature TL of the light emitting device 3 is 145 degrees C. from TL=110+50×0.7=145. As this occurs, at a point in time A, the divided voltage value of the temperature detection signal Std reaches the voltage value of the comparison signal Sx, and the voltage value of a cathode of a diode 44*c* reaches the voltage value of a current detection signal Sid. Then, in the diode 44*c*, the cathode voltage of the diode 44*c* is output via a resistance element 44*i* as the regulation signal Sa in such a state that the cathode voltage is added to a current detection signal Sid, whereby an output current IL is decreased by a control unit 50 from a predetermined output current value IL0, which is 0.7 A (a point in time A in FIG. 5D).

Accordingly, in the regulation signal generation unit 41, by decreasing the self-heat value of the light emitting device drive circuit 2A, the internal temperature TD of the case 110 of the light emitting device drive circuit 2A is controlled so as not to exceed the maximum rated temperature TDmax, which is 110 degrees C. (a time period B to H in FIG. 5C). As a result, the self-heat value of the light emitting device 3 is decreased, whereby the temperature TL of the light emitting device 3 is decreased (a time period B to H in FIG. 5B).

In this modified example, the output current is decreased so that the internal temperature TD of the case 110 of the light emitting device drive circuit 2A does not exceed the maximum rated temperature TDmax, which is 110 degrees C., and for example, when the output current IL is decreased to 0.4 A at a point in time H, the temperature TL of the light emitting device 3 is decreased to 130 degrees C.

$$TL=110+50\times0.4=130 \text{ degrees C.}$$

Also, with the light emitting device drive circuit 2A and the vehicle lamp 1A of the modified example, a similar advantage to that of the embodiments described above can be obtained.

While in the modified example, the example has been illustrated in which the light emitting device drive circuit 2A does not include the temperature decrease detection unit 42, even in the event that a configuration may be adopted for the light emitting device 2 of embodiments in which the amplification factor of the temperature decrease detection unit 42 is set to be less than the temperature rise coefficient $\alpha$ which is less than 50 and the voltage value of the comparison signal Sx is set to a voltage value which is a voltage value conforming to the maximum rated temperature TD of the light emitting device drive circuit 2 and the divided voltage value of the temperature detection signal Std of the temperature detection unit 30 when the internal temperature TD of the case 110 of the light emitting device drive circuit 2 is the maximum rated temperature TLmax, the voltage value of the comparison signal Sx so set can be made not to rise by the function of the current attraction circuit 47, which has been described above, and as a result, a similar operation to that of the light emitting device drive circuit 2A of the modified example shown in FIGS. 5A to 5D can be obtained.

In addition, while in the embodiments described above and the modified example, the regulation unit made up of hardware is illustrated, the regulation unit may be made comprising a microcomputer, which is made up of a processor unit for implementing various types of operations, programs for these operations, and memory for storing various set values, so as to realize the functions described above by software.

According to the light emitting device drive circuit of one or more embodiments of the present invention, the temperature rise coefficient a relative to the current of the light emitting device is set in advance in the regulation unit in such a way that the temperature TL of the light emitting device satisfies the relation of $TL=TD+\alpha\cdot IL$, whether or not the temperature TL of the light emitting device has reached the first predetermined temperature TLmax is detected by the regulation unit based on the temperature rise coefficient $\alpha$, the case internal temperature of the light emitting device drive circuit detected by the temperature detection unit (i.e., the temperature of the light emitting device drive circuit itself), the output current of the power conversion unit detected by the current detection unit (i.e., the current which flows through the light emitting device), and the predetermined output current can be reduced so that TL does not exceed TLmax in the event that the result of the detection indicates that TL has reached TLmax. Consequently, according to such a light emitting device drive circuit, the restrictions on the layout of the temperature detection device (the circuit element) are reduced by detecting an ambient temperature of the light emitting device itself without disposing the temperature detection device in the vicinity thereof, thereby making it possible to control the temperature of the light emitting device so that the temperature of the light emitting device does not exceed its maximum rated temperature. As a result the decrease in the life of the light emitting device can be suppressed.

According to the light emitting device drive circuit of one or more embodiments of the present invention, because the decrease in temperature of the light emitting device is detected by the temperature decrease detection unit based on the output current of the power conversion unit detected by the current detection unit and the temperature rise coefficient in the event that the predetermined output current has been decreased and the value of the second predetermined temperature TDth is changed by the regulation signal generation unit so that the second predetermined temperature TDth does not exceed the third predetermined temperature TDmax according to the variation of the decrease in temperature from the temperature decrease detection unit in the event that the predetermined output current has been decreased, the predetermined output current can be decreased so that the case internal temperature TD does not exceed the third predetermined temperature TDmax. Consequently, the temperature of the light emitting device drive circuit itself can also be controlled so that the temperature of the light emitting device drive circuit does not exceed the maximum rated temperature of the interior part. As a result the reduction in the life of the interior part of the light emitting device drive circuit can be suppressed, and the operation of the light emitting device drive circuit can be stabilized.

According to the configurations that have been described above, because the regulation unit can be made up of the amplifier circuit and the electric circuit such as a resistance element, the regulation unit can be configured easily and simply.

According to the vehicle lamp of one or more embodiments, because the vehicle lamp includes the light emitting device drive circuit, the reduction in the life of the light emitting device can be suppressed, and as a result the reduction in the life of the vehicle lamp can be suppressed.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A light emitting device drive circuit for supplying a predetermined output current IL0 to a light emitting device to drive the light emitting device, the light emitting device drive circuit comprising:

a power conversion unit for receiving an input electric power and performing an electric power conversion on the input electric power in accordance with a control signal so as to generate the predetermined output current;

a current detection unit for detecting an output current IL of the power conversion unit;

a temperature detection unit for detecting a case internal temperature TD, which is an interior temperature of a case for accommodating the light emitting device drive circuit;

a regulation unit being operable to:

a) detect whether a temperature TL of the light emitting device has reached a first predetermined temperature TLmax based on TD, IL, and a temperature rise coefficient $\alpha$ in connection with IL, the temperature rise coefficient $\alpha$ being set in advance so that TL satisfies a relationship of $TL=TD+\alpha \cdot IL$, and b) generate a regulation signal for reducing IL0 so that TL does not exceed TLmax in the event that a result of the detection indicates that TL has reached TLmax; and a control unit for controlling IL0 in accordance with the regulation signal from the regulation unit.

2. The light emitting device drive circuit as set forth in claim 1, wherein the regulation unit comprises a regulation signal generation unit, and wherein the regulation signal generation unit detects whether TL has reached TLmax by detecting whether TD has reached a second predetermined temperature TDth, which is set in advance so as to satisfy a relationship of $TDth=TLmax-\alpha \cdot IL0$, and generates the regulation signal so as to prevent TD from exceeding TDth in the event that a result of the detection indicates that TD has reached TDth.

3. The light emitting device drive circuit as set forth in claim 2, wherein the regulation unit flier comprises a temperature decrease detection unit for detecting a decrease in temperature of the light emitting device based on IL and $\alpha$ in the event that IL0 has been decreased, and wherein the regulation signal generation unit regulates the regulation signal so that TD does not exceed a third predetermined temperature TDmax by changing TDth in a range that TDth does not exceed TDmax in accordance with a variation of the decrease in temperature from the temperature decrease detection unit in the event that IL0 has been decreased.

4. The light emitting device drive circuit as set forth in claim 3, wherein the current detection unit generates a current detection signal in accordance with IL, wherein the temperature detection unit generates a temperature detection signal in accordance with TD, wherein the temperature decrease detection unit comprises an amplifier circuit that utilizes the temperature rise coefficient $\alpha$ as an amplification factor and the temperature decrease detection unit generates a temperature decrease signal in which a value of the current detection signal is amplified in the event that the value of the current detection signal has decreased, and wherein the regulation signal generation unit comprises:

a comparison signal generation circuit for generating a comparison signal in accordance with TDth and changing the comparison signal in accordance with a variation of the temperature decrease signal; and a regulation signal generation circuit for receiving the comparison signal and the temperature detection signal and generating the regulation signal in which the value of the current detection signal is regulated based on a difference in value between the comparison signal and the temperature detection signal.

5. A vehicle lamp comprising:

a light emitting device; and a light emitting device drive circuit for supplying a predetermined output current IL0 to a light emitting device to drive the light emitting device, the light emitting device drive circuit comprising:

a power conversion unit for receiving an input electric power and performing an electric power conversion on the input electric power in accordance with a control signal so as to generate the predetermined output current;

a current detection unit for detecting an output current IL of the power conversion unit;

a temperature detection unit for detecting a case internal temperature TD, which is an interior temperature of a case for accommodating the light emitting device drive circuit;

a regulation unit being operable to:

a) detect whether a temperature TL of the light emitting device has reached a first predetermined temperature TLmax based on TD, IL, and a temperature rise coefficient $\alpha$ in connection with IL, the temperature rise coefficient $\alpha$ being set in advance so that TL satisfies a relationship of $TL=TD+\alpha \cdot IL$, and b) generate a regulation signal for reducing IL0 so that TL does not exceed TLmax in the event that a result of the detection indicates that TL has reached TLmax; and a control unit for controlling IL0 in accordance with the regulation signal from the regulation unit.

6. The vehicle lamp of claim 5, wherein the regulation unit comprises a regulation signal generation unit, and wherein the regulation signal generation unit detects whether TL has reached TLmax by detecting whether TD has reached a second predetermined temperature TDth, which is set in advance so as to satisfy a relationship of TDth=TLmax−α·IL0, and generates the regulation signal so as to prevent TD from exceeding TDth in the event that a result of the detection indicates that ID has reached TDth.

7. The vehicle lamp of claim 5, wherein the regulation unit further comprises a temperature decrease detection unit for detecting a decrease in temperature of the light emitting device based on IL and α in the event that IL0 has been decreased, and wherein the regulation signal generation unit regulates the regulation signal so that TD does not exceed a third predetermined temperature TDmax by changing TDth in a range that TDth does not exceed TDmax in accordance with a variation of the decrease in temperature from the temperature decrease detection unit in the event that IL0 has been decreased.

8. The vehicle lamp of claim 5, wherein the temperature decrease detection unit comprises an amplifier circuit that utilizes the temperature rise coefficient a as an amplification factor and the temperature decrease detection unit generates a temperature decrease signal in which a value of the current detection signal is amplified in the event that the value of the current detection signal has decreased, and wherein the regulation signal generation unit comprises:

a comparison signal generation circuit for generating a comparison signal in accordance with TDth and changing the comparison signal in accordance with a variation of the temperature decrease signal; and a regulation signal generation circuit for receiving the comparison signal and the temperature detection signal and generating the regulation signal in which the value of the current detection signal is regulated based on a difference in value between the comparison signal and the temperature detection signal.

9. A vehicle lamp comprising:

a light emitting device; and a light emitting device drive circuit for supplying a predetermined output current IL0 to a light emitting device to drive the light emitting device, the light emitting device drive circuit comprising:

a power conversion unit for receiving an input electric power and performing an electric power conversion on the input electric power in accordance with a control signal so as to generate the predetermined output current;

a current detection unit for detecting an output current IL of the power conversion unit;

a temperature detection unit for detecting a case internal temperature TD, which is an interior temperature of a case for accommodating the light emitting device drive circuit;

a regulation unit being operable to:

a) detect whether a temperature TL of the light emitting device has reached a first predetermined temperature TLmax based on TD, IL and a temperature rise coefficient α in connection with IL, the temperature rise coefficient α being set in advance so that TL satisfies a relationship of TL=TD+α·IL, and b) generate a regulation signal for reducing IL0 so that TL does not exceed TLmax in the event that a result of the detection indicates that TL has reached TLmax; and a control unit for controlling IL0 in accordance with the regulation signal from the regulation unit, wherein the regulation unit includes a regulation signal generation unit, wherein the regulation signal generation unit detects whether TL has reached TLmax by detecting whether TD has reached a second predetermined temperature TDth which is set in advance so as to satisfy a relationship of TDth=TLmax−α·IL0, and generates the regulation signal so as to prevent TD from exceeding TDth in the event that a result of the detection indicates that TD has reached TDth, wherein the regulation unit further comprises a temperature decrease detection unit for detecting a decrease in temperature of the light emitting device based on IL and α in the event that IL0 has been decreased, wherein the regulation signal generation unit regulates the regulation signal so that TD does not exceed a third predetermined temperature TDmax by changing TDth in a range that TDth does not exceed TDmax in accordance with a variation of the decrease in temperature from the temperature decrease detection unit in the event that IL0 has been decreased, wherein the current detection unit generates a current detection signal in accordance with IL, wherein the temperature detection unit generates a temperature detection signal in accordance with TD, wherein the temperature decrease detection unit includes an amplifier circuit which utilizes the temperature rise coefficient α as an amplification factor and the temperature decrease detection unit generates a temperature decrease signal in which a value of the current detection signal is amplified in the event that the value of the current detection signal has decreased, and wherein the regulation signal generation unit comprises:

a comparison signal generation circuit for generating a comparison signal in accordance with TDth and changing the comparison signal in accordance with a variation of the temperature decrease signal; and a regulation signal generation circuit for receiving the comparison signal and the temperature detection signal and generating the regulation signal in which the value of the current detection signal is regulated based on a difference in value between the comparison signal and the temperature detection signal.

* * * * *